United States Patent [19]

Womack

[11] Patent Number: 4,968,011

[45] Date of Patent: Nov. 6, 1990

[54] MODEL MARKER'S, LOCKSMITH'S, AND JEWELER'S SMALL VICE

[76] Inventor: Robert C. Womack, 5119 Radbrook Pl., Dallas, Tex. 75220

[21] Appl. No.: 471,434

[22] Filed: Jan. 29, 1990

[51] Int. Cl.[5] ..... B25B 1/10

[52] U.S. Cl. ..... 269/76; 269/96; 269/101; 269/244

[58] Field of Search ..... 269/240, 244, 247, 249, 269/250, 251, 96, 101, 76

[56] References Cited

U.S. PATENT DOCUMENTS

| | | | |
|---|---|---|---|
| 1,929,258 | 10/1933 | Petersen et al. | 269/244 |
| 2,205,674 | 6/1940 | Schroeder | 269/247 |
| 2,735,462 | 2/1956 | Olsen | 269/249 |
| 4,363,475 | 12/1982 | McCarty | 269/96 |
| 4,593,892 | 6/1986 | Tertegge | 269/244 |
| 4,759,535 | 7/1988 | Takasugi | 269/246 |

*Primary Examiner*—Robert C. Watson

[57] ABSTRACT

A small size vice constructed to hold small parts while being work processed on up to three sides with one clamping of the part being work processed. The small vice uses a rigid frame design applicable for being clamped in a larger bench vice, bench mount bracket or machine table clamp having rigidity not found in small vices. The small size vice has narrow jaws and very long movable jaw travel for it's jaw width and with the jaw travel perpendicular to the clamping surfaces of the jaws. The small size vice also has an underside rigid web reinforcing substantially the length of the vice to prevent the vice from bowing from vice jaw clamping force and to provide a web for being clamped in a larger bench vice (or other clamping device) with the smaller size holding small parts being worked on over to one side of the bench vice. The two sided shoulder at the top of the underside rigid web prevents vice slip down when the small vice is clamped in the jaws of a larger vice.

20 Claims, 3 Drawing Sheets

MODEL MARKER'S, LOCKSMITH'S, AND JEWELER'S SMALL VICE

Figure 1:
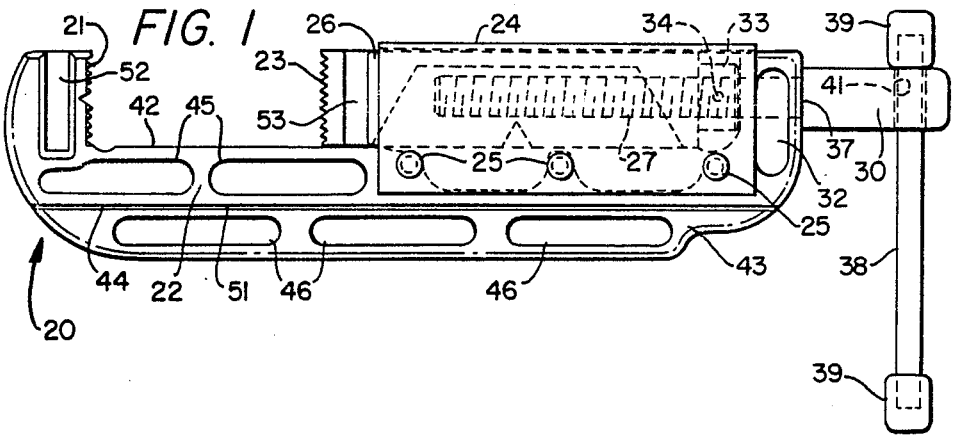

This invention relates in general to work piece holding devices, and more particularly, to a model maker's, locksmith's, and jeweler's small vice clamp mountable in a larger bench vice, bench mount bracket or a machine table clamp.

There has been a need in locksmithing for a small vice to hold lock body cylinders so the locksmith can get at both ends of a lock cylinder and the top of the lock cylinder. In order to remove a lock cylinder plug for rekeying, it is necessary to either pick the lock open, shim the lock open, or have a key that is made to open the lock. In both of the first two options it is necessary to get at both ends of the lock cylinder. A small vice mountable in a larger bench vice or other clamping devices is needed to rigidly hold small parts while they are being worked on with files, engraving tools, small hand grinders, drills and other work tools. It is important that such a small vice have a bottom longitudinal rib for being clamped in a bench vice or machine vice. The small vice should have soft removable jaws and be made of metal castings or relatively hard plastic.

It is therefore a principal object of this invention to provide a small vice adapted to being mounted in a larger bench vice, bench mount or a machine table clamp.

Another object is to provide a small vice for holding small objects being worked on.

A further object is to provide such a small vice that includes provisions for mounting soft removable jaws.

Still another object is to mount pieces being worked on in a small vice for optimal area exposure for working the piece being held in the small vice.

Another object is to make working small work pieces easier and safer for the model maker, hobbiest, locksmith, gunsmith and jeweler.

Features of the invention useful in accomplishing the above objects include, in a model maker's, locksmith's and jeweler's small vice, a small size vice constructed to hold small parts while being work processed on up to three sides with one clamping of the part being work processed. The small vice uses a rigid frame design adapted for being clamped in a larger bench vice, bench mount bracket or machine table clamp having rigidity not found in small vices. The small size vice has narrow jaws and very long movable jaw travel for it's jaw width and with the jaw travel perpendicular to the clamping surfaces of the jaws. The small size vice also has an underside rigid web reinforcing substantially the length of the vice to prevent the vice from bowing from vice jaw clamping force and to provide a web for being clamped in a larger bench vice (or other clamping device) with the smaller size holding small parts being worked on over to one side of the bench vice. A two sided shoulder at the top of the underside rigid web prevents vice slip down when the small vice is clamped in the jaws of a larger vice. The small vice made of metal castings or hard plastics is provided with special slots to retain mount soft removable jaws, and is a vice that has all corners rounded to be easy on the user's hands when holding small parts for hand working. The small vice is easily manufactured because of it's shape lending itself to grinding of many pieces of the body and moving jaw on big magnetic chuck surface grinders, and is a vice easy to build with precision with, for example the cover guide being precision drawn to fit with only a thousandth clearance on the moving jaw of the vice in a vice that that opens extra wide for it's thickness.

A specific embodiment representing what is presently regarded as the best mode of carrying out the invention is illustrated in the accompanying drawings.

Figure 2:
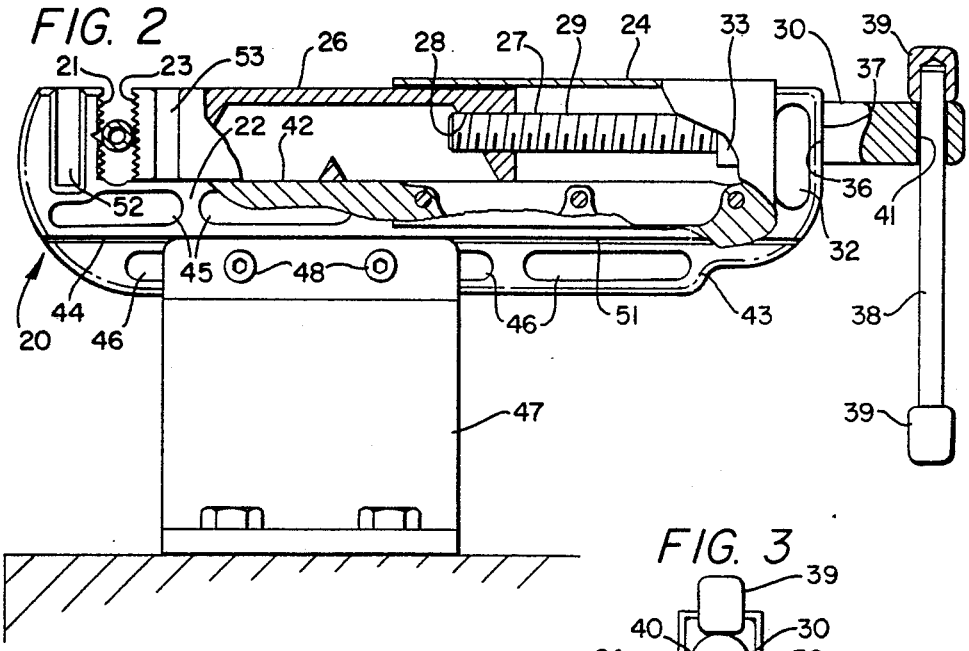
Figure 3:
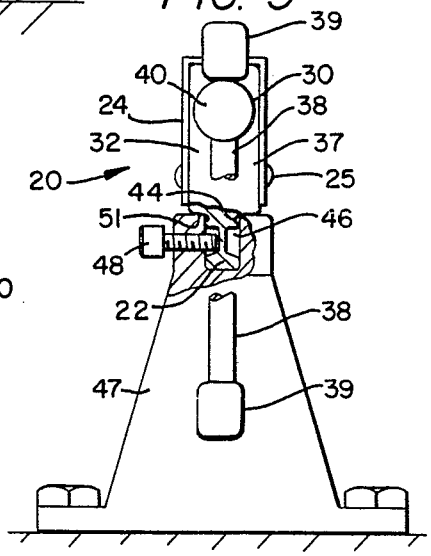
Figure 4:
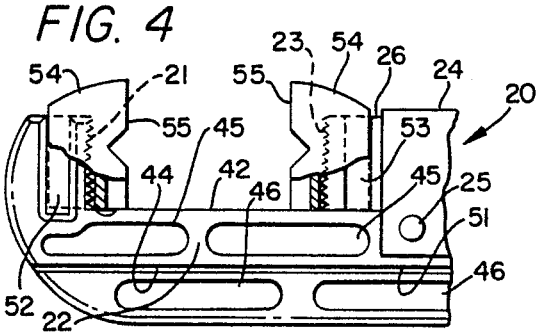
Figure 5:
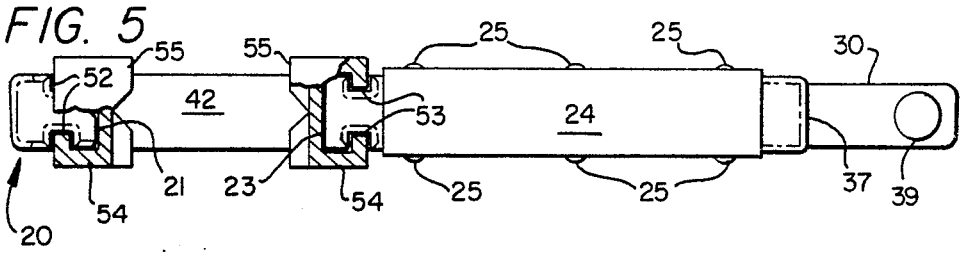
Figure 6:
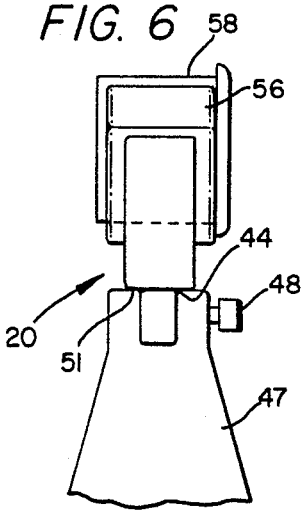
Figure 7:
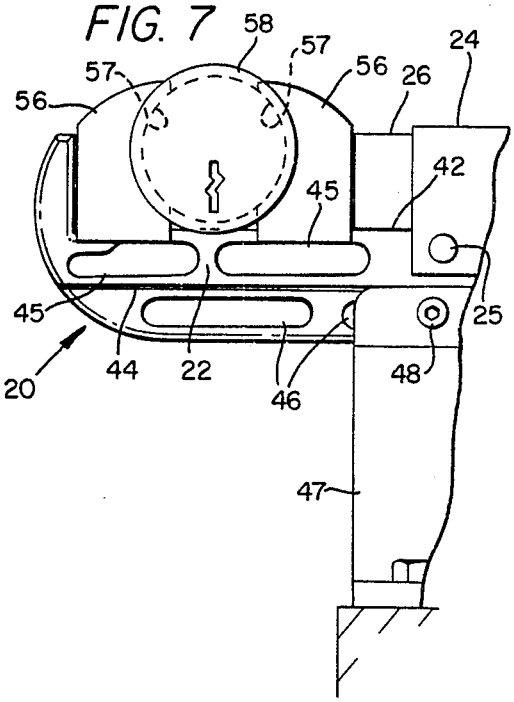
Figure 8:
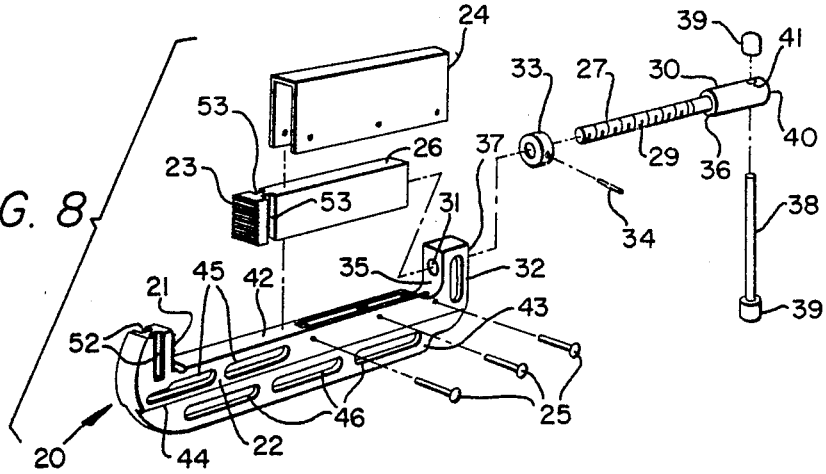
Figure 10:
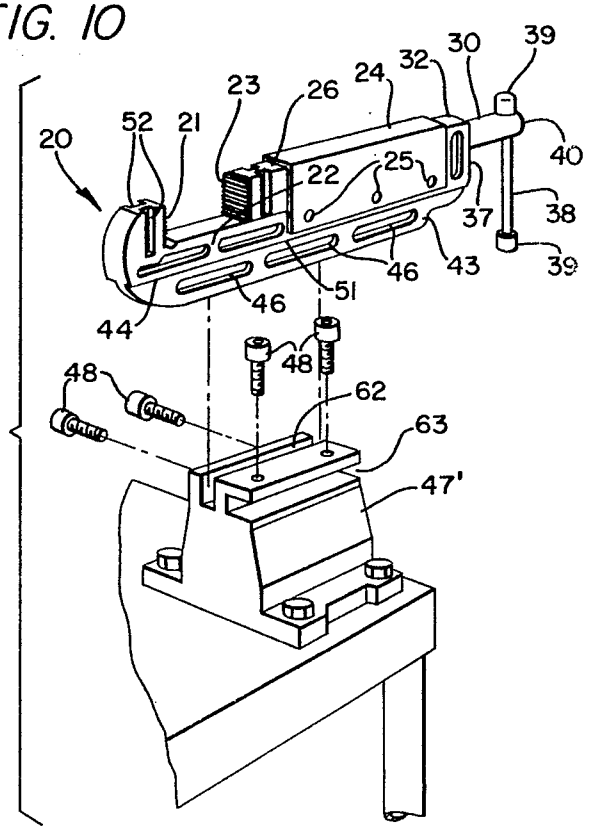
Figure 9:
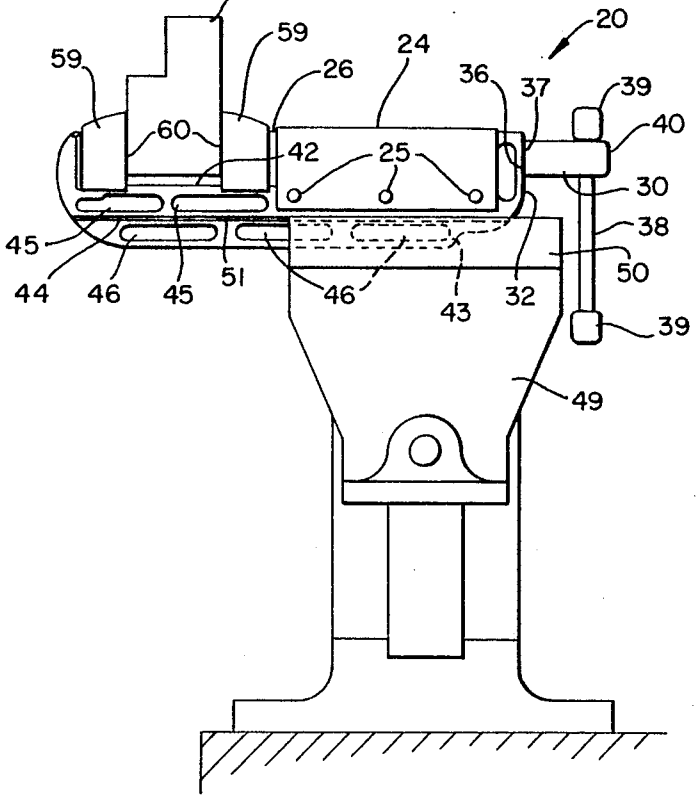

In the drawings:

FIG. 1 represents a side elevation view of applicant's small size vice;

FIG. 2, a partially cut away and sectioned view of the small vice of FIG. 1 showing interior detail and with the small vice mounted in a bench mount bracket;

FIG. 3, an end elevation view of the vice and bench mount bracket partially broken away to show mounting detail;

FIG. 4, a partial side elevation view of the vice with soft removable jaws partially broken away to show mounting detail of the soft removable jaws;

FIG. 5, a top plan view of the vice with soft removable jaws partially broken away to show mounting detail of the soft removable jaws;

FIG. 6, a jaw end elevation view of the vice in a bench mounting bracket, and with soft jaws mounting a lock cylinder for locksmithing;

FIG. 7, a partial side elevation view of the vice and mounting bench bracket of FIG. 6, showing more detail of the soft jaws mounting of a lock cylinder;

FIG. 8, an exploded disassembled view of applicant's small size vice;

FIG. 9, a side elevation view of the vice mounted in a bench vice; and,

FIG. 10, a perspective view or the vice lifted vertically from a bench mounting bracket that the vice could be mounted in either vertically or on one side.

Referring to the drawings:

The small size vice 20 of FIGS. 1–10 is shown to have a fixed vice jaw 21 that is an integral extension from elongate vice body 22 that mounts moveable vice jaw 23. A dust cover and jaw guide 24 mounted by screws 25 to opposite sides of the vice body 22, retains and guides the movable vice jaw 23 and jaw mounting block 26 through it's range of back and forth travel as positioned by drive screw 27. Movable vice jaw 23 is part of and an end of jaw mounting block 26 having internal threads 28 that interact with drive threads 29 on jaw positioning drive shaft 30 that extends through opening 31 in rear extension 32 from elongate vice body 22. Sleeve member 33, that is fastened to drive shaft 30 by pin 34, limits longitudinal movement of the drive shaft 30 by travel limit engagement with the inner face 35 of rear extension 32, and shaft shoulder 36 limits movement of the shaft 30 in the other direction by engagement with the outer face 37 of rear extension 32. A manual crank turn shaft 38, with opposite end retaining knobs 39, extends through shaft 30 outer end 40 opening 41. An advantage of the small size vice 20 is that for hobby shop and amateur work, it can be made from plastic or aluminum, other than for the jaw guide 24 and jaw drive shaft 30, and for professional use it can be made of steel to a high degree of precision. When made of steel the small size vice 20 can be precision ground by surface grinders using large flat magnetic chucks with the surface grinders easily grinding large quantities of the small vice frames parallel while holding tolerances of tenths of one thousandths of an inch. When the combination dust cover and jaw guide 24 is precision drawn over a mandrel and the movable vice jaw 23 mounting block 26 is ground just one or two thousandths of an inch thinner than the elongate vice body 22 and the inside width of the jaw guide 24 you have precision guiding of the movable vice jaw 23 that otherwise is very hard to achieve and quite expensive if manufactured using other designs and production techniques. With applicant's small vice 20 every part is made for precision fit of all parts easily and inexpensively. Ease of mass production while maintaining high precision is facilitated in that both the small vice 20 frame body 22 and the movable jaw block 26 are flat and can be precision ground or machined without the use of angle plates and/or vices in manufacturing. This small size vice 20 has very narrow jaws and unusually long movable jaw travel for it's jaw width, and the jaw travel is perpendicular to the clamping surfaces of the jaws to thereby hold parts of varying thickness better. Typically the small size vice 20 has measurements of nine sixteenths of an inch thick with movable vice jaw travel of one and eleven sixteenths inches travel and a body length of approximately six and three fourth inches in a vice where the movable vice jaw 23 mounting block 26 slides on and along body surface 42.

The elongate vice body 22 has a bottom underside rigid web 43 reinforcing substantially the length of the vice 20 body 22, that resists bowing of the vice body from vice jaw clamping force, and that is narrower than the main upper body portion 44 and is symetrically centered with respect thereto. While there are material relief openings 45 in body portion 44 and material relief openings 46 in web 43, the web 43 may be clamped in a bench bracket 47 with retaining screws 48 tightened down into web relief openings 46 as shown in FIGS. 2 and 3 or clamped in a bench vice 49, as shown in FIG. 9, with jaws 50 of the vice 49 tightened on the web 43, without damage thereto, bearing against the web top to upper body portion shoulders 51. Shoulders 51 prevent the small vice 20 from slipping down in a bench vice when clamped in the larger vice jaws and the user puts downward force on a part clamped in the small vice such as would occur with riveting or drilling on a part clamped in the small vice. The small vice 20 is provided with special slots 52 and 53, open from the top, immediately behind the fixed jaw 21 and the movable jaw 23, respectively, to retain mount soft removable jaws 54 of plastic therein, or other soft or hard jaw elements. These jaw elements are molded or machined to fit the small vice 20 with the slots (or pockets) 52 and 53 preventing the jaw elements from falling off the small vice jaws when in use. The soft removable jaws 54, as shown mounted in place in FIGS. 4 and 5, are face 55 configured for some work applications, the soft removable jaws 55 have cylindrical indented faces 57 for holding a cylindrical article such as a lock cylinder 58 as shown in FIGS. 6 and 7, and in FIG. 9 soft removable jaws 59 are shown to have flat jaw faces 60 holding a work piece 61. It should be noted that all corners of the small vice 20 are rounded to be easy on the user's hands when the vice is holding small parts for handworking. The bench mounting bracket 47'of FIG. 10 has a mounting slot 62 for vertical mounting of the small vice 20, just like with the bench mounting bracket 47 of FIGS. 2, 3, 6 and 7, and also, a side mounting slot 63 for mounting a small vice 20 to the side of the bracket 47.

Whereas this invention has been described with respect to several embodiments thereof, it should be realized that various changes may be made without departure from the essential contributions to the art made by the teachings hereof.

I claim:

1. A small size vice for holding small parts while being work processed comprising: an elongate vice body having flat parallel opposite sides, an integral jaw extension from a front jaw end of said elongate vice body formed with a fixed vice jaw face and having flat parallel opposite sides that are continuations of said flat parallel opposite sides of the elongate vice body, and a rear integral extension from the rear end of said elongate vice body in the same direction as said integral jaw extension and formed with flat parallel opposite sides that are continuations of said flat parallel opposite sides of the elongate vice body; a smooth flat surface on said vice body extending a substantial portion of the distance between said integral jaw extension and said rear integral extension and extending between and perpendicular to said flat parallel opposite sides of said elongate vice body; a movable jaw mounting block rectangular in form, formed with a movable jaw at a forward jaw end and a threaded opening in a rear end wall through to interior opening means of said movable jaw mounting block; said movable jaw mounting block having flat parallel opposite sides spaced approximately the width of said flat parallel opposite sides of said elongate vice body; said movable jaw mounting block having flat parallel smooth top and bottom slide surfaces perpendicular to said flat parallel opposite sides of said elongate vice body wherein said block flat bottom slide surface is slidable along said smooth flat surface on said vice body; said movable jaw mounting block being an elongate block of substantial length relative to it's width; elongate enclosure motion guide means for said movable jaw mounting block fastened to opposite sides of said elongate vice body and enclosing a substantial portion of the length of said elongate moveable jaw mounting block with small precision spacing for precision guided back and forth movement of said elongate movable jaw mounting block; and screw thread drive means for said elongate moveable jaw mounting block extended through said rear integral extension of said vice body and through in threaded engagement with said threaded opening in the rear end wall of said movable jaw mounting block.

2. The small size vice of claim 1, wherein said elongate vice body is integrally formed with a main upper body portion and a bottom underside rigid reinforcing web protection extending substantially the length of said main upper body portion of said elongate vice body that resists bowing of the vice body from force reaction to vice jaw clamping force; with said bottom underside rigid reinforcing web projection narrower than said main upper body portion of said elongate vice body; and wherein said bottom underside rigid reinforcing web projection is symetrically centered with respect to said main upper body portion of said elongate vice body.

3. The small size vice of claim 2, wherein there are shoulders on said main upper body portion of said elongate vice body extending to opposite sides of said bottom underside rigid reinforcing web projection that limit upward movement of a clamp mount clamp support engaging said bottom underside rigid reinforcing web projection and said shoulders.

4. The small size vice of claim 3, wherein there are material relief openings in said bottom underside rigid reinforcing web projection.

5. The small size vice clamp of claim 4, wherein there are material relief openings in said main upper body portion of said elongate vice body.

6. The small size vice clamp of claim 3, wherein said elongate enclosure guide means for said movable jaw mounting block is a metal "U" shaped mandrel formed enclosure mounted by screws to opposite sides of said elongate vice body.

7. The small size vice of claim 6, wherein said movable jaw mounting block is form finished in the range of one to three thousands of an inch thinner between said parallel opposite sides of the block than the width between said flat parallel opposite sides of said elongate vice body and the inside width of said metal "U" shaped enclosure.

8. The small size vice of claim 7, wherein said screw thread drive means is a shaft member mounting a sleeve fixed thereto engaging the inner face of said rear integral extension of said vice body and shoulder means on said shaft member engages the outer face of said rear integral extension of said vice body to hold said shaft member longitudinally in place as it is rotated to screw drive said elongate movable jaw mounting block back and forth through its total range of vice jaw movement.

9. The small size vice of claim 8, wherein said screw thread drive means shaft member includes manual crank turn means mounted on its outer rear end.

10. The small size vice of claim 9, wherein said movable jaw and said movable jaw mounting block travel is perpendicular to the clamping surfaces of the vice jaws to hold parts of varying thickness better.

11. The small size vice of claim 10, wherein the vice has narrow jaws and a narrow body as related to long movable jaw travel with, the jaws and body approximately one half inch thick, movable vice jaw travel approximately one and three fourth inches travel, and a body length approximately six and three fourth inches long.

12. The small size vice of claim 10, wherein the integral jaw extension is provided with opposite side slots open from the top parallel to the fixed jaw face and immediately behind the fixed jaw face; the movable jaw mounting block is provided with opposite side slots open from the top parallel to the movable jaw face and immediately behind the movable jaw face; and removable jaws configured to fit the small vice jaws with projections received in the slots behind respective jaw faces to prevent said removable jaws from falling off the small vice jaws when in use.

13. The small size vice of claim 12, wherein said removable jaws are relatively soft material jaws of plastic configured for work applications desired.

14. The small size vice of claim 13, wherein said removable jaws have cylindrical indented faces for holding a cylindrical article.

15. The small size vice of claim 13 wherein said removable jaws have grid indented faces for effective gripping of a work piece mounted in the vice.

16. The small size vice of claim 13, wherein said removable jaws have flat jaw faces for holding a work piece mounted in the vice.

17. The small size vice of claim 10, wherein said screw thread means shaft member is a precision metal member along with said elongate "U" shaped enclosure member.

18. The small size vice of claim 17, wherein said elongate vice body is plastic; and said movable jaw mounting block is plastic.

19. The small size vice of claim 17, wherein said elongate vice body is metal; and said movable jaw mounting block is metal.

20. The small vice of claim 19, wherein the metal of the elongate vice body and the movable jaw mounting block are steel precision ground on parallel sides while holding tolerances as fine as tenths of one thousandths of an inch.

* * * * *